US006182336B1

(12) United States Patent
Bauer

(10) Patent No.: US 6,182,336 B1
(45) **Date of Patent: *Feb. 6, 2001**

(54) MAGNETIC SAFETY SNAP LOCKING DEVICE AND METHOD OF FASTENING THE DEVICE WITH MANUAL RESETTING

(76) Inventor: Irving Bauer, Rte. 4, Box Y23, Mount Kisco, NY (US) 10549

( * ) Notice: Under 35 U.S.C. 154(b), the term of this patent shall be extended for 0 days.

This patent is subject to a terminal disclaimer.

(21) Appl. No.: 09/252,086

(22) Filed: Feb. 18, 1999

(51) Int. Cl.[7] ..... A44B 21/00
(52) U.S. Cl. ..... 24/303; 24/66.1; 292/251.5
(58) Field of Search ..... 24/303, 66.1, 658, 24/688; 292/251.5

(56) References Cited

U.S. PATENT DOCUMENTS

| | | | | |
|---|---|---|---|---|
| 3,018,652 | | 1/1962 | Dubonnet . | |
| 3,036,453 | | 5/1962 | Dubonnet . | |
| 4,021,891 | | 5/1977 | Morita . | |
| 4,099,755 | | 7/1978 | Anderson . | |
| 4,265,002 | * | 5/1981 | Hosken | 24/303 |
| 4,453,294 | | 6/1984 | Morita . | |
| 4,455,719 | | 6/1984 | Morita . | |
| 4,458,395 | | 7/1984 | Aoki . | |
| 4,458,396 | | 7/1984 | Aoki . | |
| 4,480,381 | | 11/1984 | Collet et al. . | |
| 4,779,314 | | 10/1988 | Aoki . | |
| 4,941,235 | * | 7/1990 | Aoki | 24/303 |
| 4,991,270 | | 2/1991 | Aoki . | |
| 5,042,116 | | 8/1991 | Ossiani . | |
| 5,125,134 | | 6/1992 | Morita . | |
| 5,142,746 | | 9/1992 | Morita . | |
| 5,152,035 | | 10/1992 | Morita . | |
| 5,199,138 | | 4/1993 | Morita . | |
| 5,208,951 | | 5/1993 | Aoki . | |
| 5,253,394 | | 10/1993 | Morita . | |
| 5,274,889 | | 1/1994 | Morita . | |
| 5,377,392 | | 1/1995 | Morita . | |
| 5,473,799 | | 12/1995 | Aoki . | |
| 5,515,581 | | 5/1996 | Kaufmann . | |
| 5,560,089 | | 10/1996 | Morita . | |
| 5,572,772 | | 11/1996 | Morita . | |
| 5,572,773 | | 11/1996 | Bauer . | |
| 5,618,071 | | 4/1997 | Aoki . | |
| 5,647,101 | | 7/1997 | Aoki . | |
| 5,675,874 | | 10/1997 | Chen . | |
| 5,707,091 | | 1/1998 | Morita . | |
| 5,868,445 | | 2/1999 | Kaufman . | |
| 5,937,487 | * | 8/1999 | Bauer | 24/303 |

FOREIGN PATENT DOCUMENTS

| | | |
|---|---|---|
| 2 665 212 | 1/1992 | (FR) . |

* cited by examiner

*Primary Examiner*—Victor N. Sakran
(74) *Attorney, Agent, or Firm*—Oblon, Spivak, McClelland, Maier & Neustadt, P.C.

(57) ABSTRACT

A magnetic fastener includes manually separable male and female assemblies, the female assembly including a movable lock member freely slidably positioned thereon and a lock release button movably mounted thereto. The fastener also includes a male assembly including a magnetic member, the male assembly being engageable with the lock release button. The movable lock member has an opening formed therein within which a portion of the male assembly is positionable such that, in a locked position, the movable member is shiftable to a position in proximity with the magnetic member and, upon engagement of the release button with the male assembly, the movable member is shiftable to a position spaced from the magnetic member. A method of fastening the fastener is also described. The location of the magnetic member and movable metal lock member are capable of being switched such that the magnetic member is slidable in a direction towards the metal lock member which is fixed in position within the male assembly.

62 Claims, 6 Drawing Sheets

MAGNETIC SAFETY SNAP LOCKING DEVICE AND METHOD OF FASTENING THE DEVICE WITH MANUAL RESETTING

BACKGROUND OF THE INVENTION

1. Field of the Invention

The present invention is directed to a magnetic fastener which includes manually separable male and female assemblies of a type which may be used with the closure flap of a handbag. The magnetic fastener serves to utilize attractive forces between a permanent magnet and one assembly in a ferromagnetic member and the other assembly so as to provide a magnetic, mechanically locked engagement therebetween. The locking engagement between the permanent magnet and the ferromagnetic member may then be manually released upon actuation of a lock release button.

2. Discussion of the Background

The fastener of the present invention comprises a variation of a general type of magnetic fastener such as shown in U.S. Pat. Nos. 4,021,891; 4,453,294; and 5,274,889, and more particularly, is an improvement of the magnetic type slide fasteners shown in U.S. Pat. Nos. 5,199,138; 5,253,394; 5,377,392; 5,515,581 and 5,572,772, the disclosure of each of the above-noted patents being incorporated herein by reference. The magnetic fasteners described in U.S. Pat. Nos. 4,021,891; 4,453,294 and 5,274,889 include cooperating female and male member assemblies.

SUMMARY OF THE INVENTION

The magnetic fastener of the present invention provides for a manually operable lock release button which serves to quickly and efficiently permit release of locking engagement between a male and female assembly. The female assembly includes a movable lock member freely slidably positioned therein and a lock release button movably mounted to the female assembly. The male assembly includes a magnetic member, the male member being engageable with the lock release button. The movable lock member has an opening provided therein with which a portion of the male assembly is positionable such that, in a locked position, the movable member is shiftable to a position in proximity with the ferromagnetic member and, upon engagement of the release button with the male assembly, the movable member is shiftable to a position spaced from the magnetic member so as to release locking engagement. The position of the magnetic member and the lock member are capable of being exchangeable, if desired.

A further object of the present invention is to provide a lock release button and lock member each of which is provided with cam surfaces that are spaced apart in the unlocked position and are in contact with one another in the locked position.

An additional object of the present invention is to utilize a female assembly which includes a housing within which a lock release button is movable in a first direction while the lock member is movable in a second direction transverse to the direction of movement of the lock release button.

A further object of the present invention is to provide a method fastening a fastener having the female assembly and male assembly and which includes the steps of positioning a lock member in the female assembly so as to be freely slidable therein, positioning the lock release button so as to be spaced from the lock member in the locked position of the fastener and to be in contact with the lock member in the unlocked position of the fastener and engaging the male assembly with the female assembly so as to slide the lock member from being in proximity with the magnetic member in the locked position of the fastener and to be spaced from the magnetic member in the unlocked position of the fastener. In the alternative, the position of the magnetic member and the lock member are exchangeable.

As a particularly advantageous aspect of the present invention, in addition to providing increased security of closure, a minimum number of easily manufactured and assembled parts is utilized, thereby resulting in a low cost magnetic fastener.

These and other objects of the present invention will become apparent upon consideration of the following detailed description and drawings.

DESCRIPTION OF THE PREFERRED EMBODIMENT

Figure 1:
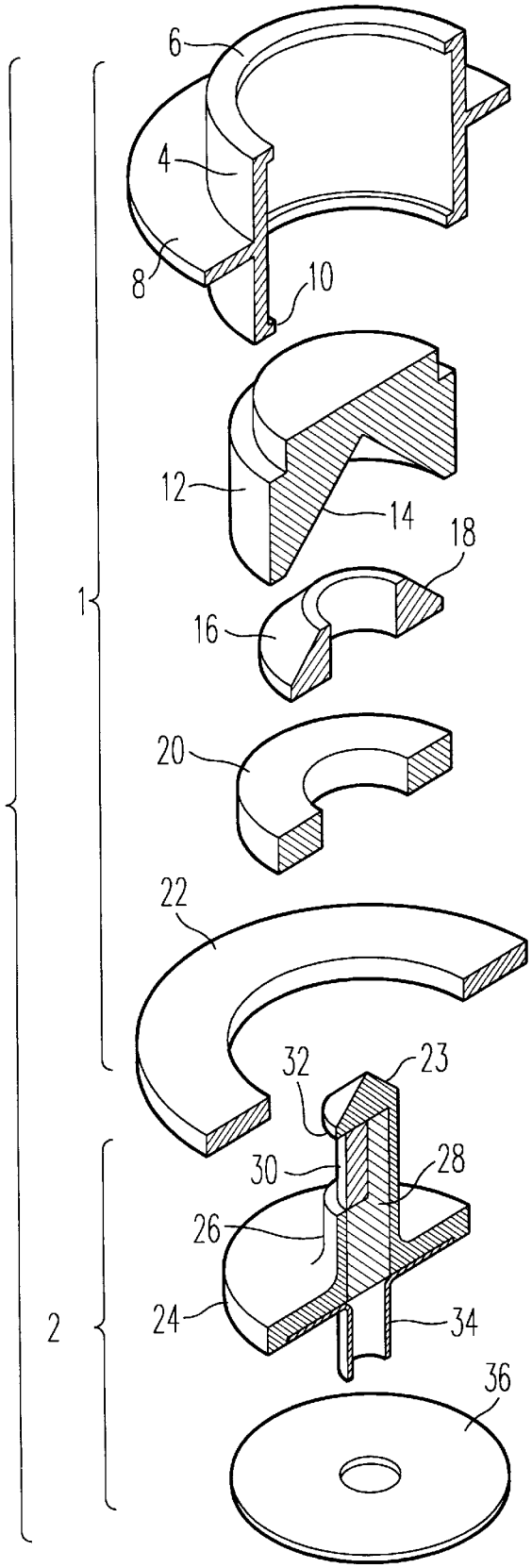
FIG. 1 is an exploded view of the principle components of the magnetic fasteners shown in accordance with the present invention.
Figure 2:
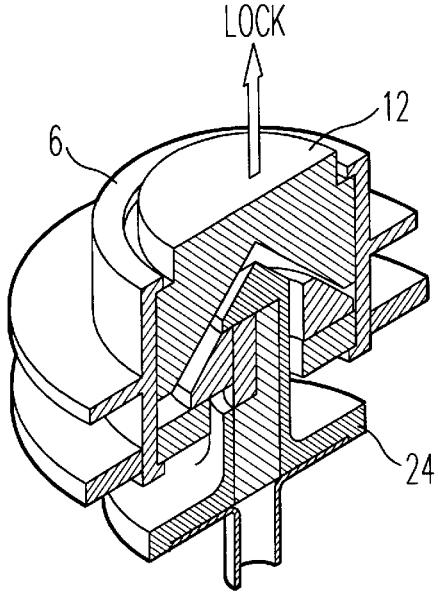
FIG. 2 is a cross-sectional view showing the locked condition of the fastener.
Figure 3:
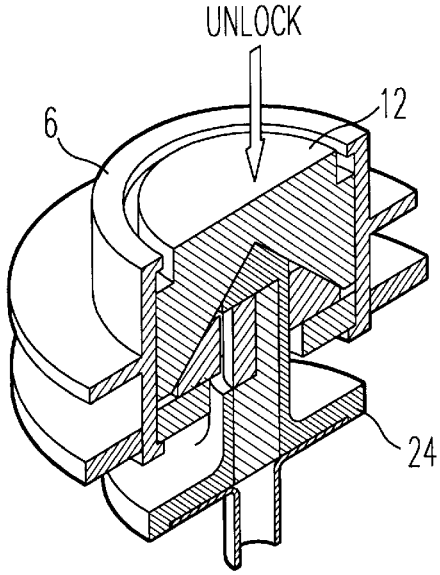
FIG. 3 is a cross-sectional view showing the fastener in an unlocked position upon downward movement of the lock release button having occurred.

Reference is now made to FIGS. 1–3 which respectively show an exploded view of the present invention, the locked condition of the fastener and the unlocked condition of the fastener.

As can be appreciated from the first embodiment shown in FIGS. 1–3, a female assembly 1 and male assembly 2 are provided. The female assembly includes an upper housing 4 which is provided with a set ring 6, a mounting flange 8 and a lower set ring 10. Positionable within the upper housing 4 is a lock release button 12 which is movable up and down within the housing due, for example, to a spring, which may be positioned beneath the lock release button 12 so as to make the lock button movable in an upward direction as illustrated in FIG. 1.

The female assembly 1 also is provided with a ferromagnetic lock ring 16 which is movable laterally with respect to the longitudinal axis of the female assembly 1 and male assembly 2. Lock release button 12 is provided with a lower cam face 14 which is engageable with a corresponding upper cam face 18 provided on the lock ring 16. Located beneath the lock ring 16 is a lower housing retention washer 20 which supports the lock ring 16 in position, a lower surface portion of the washer 20 being engageable with the lower set ring 10 of the housing 4.

As can thus be appreciated, housing 4 is formed with an upper housing portion within which the lock release button 12 is positioned and a lower housing portion within which retention washer 20 is positioned. The housing 4 may be made of plastic or metal and may also be provided with a lower housing mounting flange 22 so as to help secure a flap portion of a bag, for example, between mounting flange 8 and mounting flange 22, such as the opening and closing flap portion of a woman's purse. It is also understandable to one of ordinary skill in the art that the lower portion of the washer 20 may be provided with prongs or grommets (not shown) which are attachable to the flap portion of the purse and secure the female assembly to this portion of the purse. In such case, flange 8 would not be needed.

Opposite the female assembly 1 is positioned the male assembly 2, the male assembly including an upwardly extending member 23, a base 24, an upwardly extending flange 26, a non-ferromagnetic member or filler 28 and a magnet 30. The flange may be rounded or tapered and such flange can be hollow or solid. A locking lip portion 32 is provided at the upper portion of an opening in member or filler 28 within which the magnet 30 is positioned. A mounting grommet 34 downwardly extends from the male part and slips through an opening provided in a corresponding grommet mounting washer 36 to help secure the same to a portion of the purse opposite the closing flap. Base 24 and member 26 can be made of plastic, if desired.

As would be understandable to one of ordinary skill, it would be possible for lock ring 16 to be a magnet instead of being made of steel and that magnet 30 be a steel member instead of being a magnet. In such instance, the lock ring would be attracted to the steel member to secure the same in a locked position and be released when the lock release button is moved downwardly.

FIG. 2 serves to illustrate the fastener of the present invention when in an unlocked position wherein the lock release button 12 is spaced from the lock ring 16 whereas, in FIG. 3, the lock release button has been pushed downwardly and serves to cause lateral movement of the lock ring 16 such that the cam face 18 of lock ring 16 is shifted out of engagement with locking lip 32 of male assembly 2. In other words, downward depression of the lock release button 12 permits spacing of an internal wall portion of the lock ring 16 away from the magnet 30 so as to permit upward lifting of the housing 4 and to thus permit lifting of the flap of the purse away from male assembly 2. While housing 4, button 12 and base 24 are cylindrically shaped in this figure, they can be of any shape including being square shaped, etc. as long as such are similarly shaped so as to be cooperable together in operation.

Figure 4:
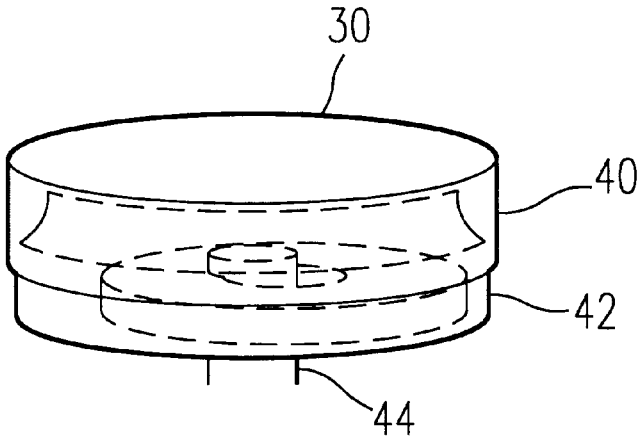
FIG. 4 illustrates the second embodiment of the present invention which utilizes a spring loaded top, first and second washers and a magnetic pin member.
Figure 5:
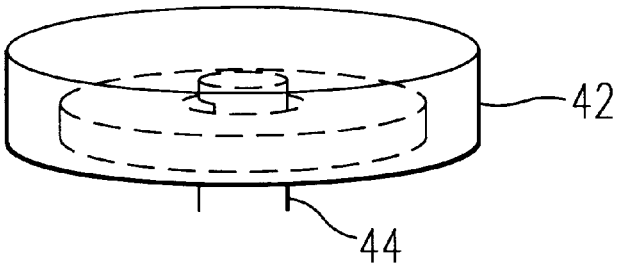
FIG. 5 illustrates the open position of the fastener in the second embodiment.
Figure 6:
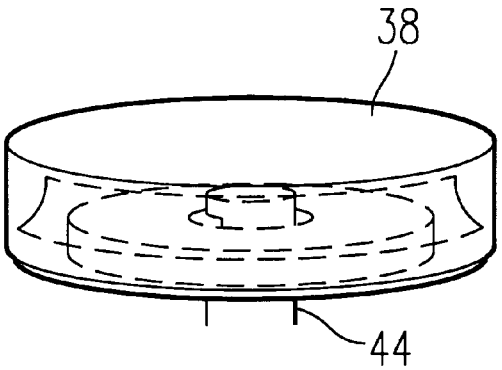
FIG. 6 further illustrates the opening position of the second embodiment wherein the spring loaded cover is pressed downwardly so as to permit the first washer to force the second washer to be aligned and properly centered with respect to the magnetic pin and to permit opening of the fastener.
Figure 7:
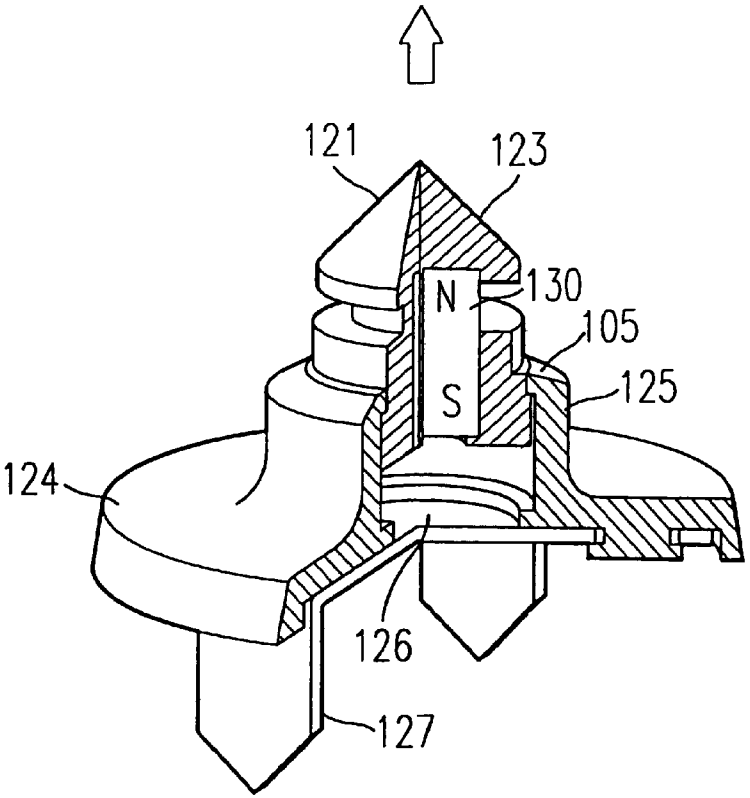
FIG. 7 illustrates a third embodiment of the present invention and shows the male portion in an extended position.

FIGS. 4–6 serve to describe details of a second embodiment of the present invention wherein in FIG. 4, the locked position is shown with respect to a top 38, a first washer 40, a second washer 42 and a pin 44 having a magnet positioned therein. The washer 42 is shiftable upon being engaged with washer 40 so as to become concentric with respect to the longitudinal axis of the pin. The open position of this embodiment is shown in FIG. 6 wherein the top 38 is pressed downward, washer 40 engages washer 42 so as to laterally shift washer 42 so as to become aligned with a center portion of the pin member 44 such that the washer 42 becomes disengaged from the pin member and permits opening of the fastener shown therein. The pin is provided with a locking lip in a manner similar to that illustrated in the embodiments shown in FIGS. 1–3.

Figure 8:
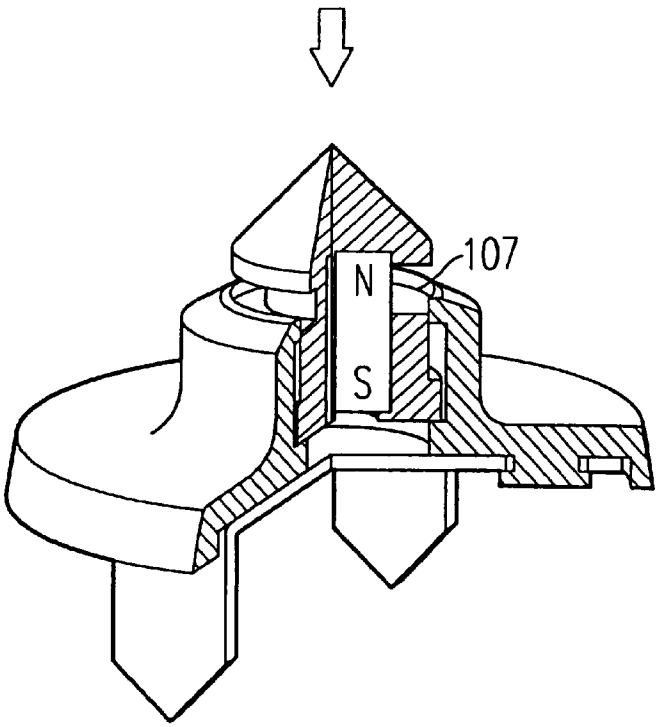
FIG. 8 shows the male member of FIG. 7 when in a retracted position.

FIGS. 7–12 show the third embodiment of the present invention which utilizes a retractable male member mounted within a housing. More particularly, the male member of this assembly is shown in cross section in FIGS. 7 and 8, which illustrate a housing 105 in the form of a crimp ring within which locking pin 123 is moveable in an upward direction so as to be extended from the housing 125. Also shown therein is the cam surface 121 of the locking pin 123 as well as magnet 130. The base portion of the male member comprises a housing 124 which has upwardly extended therefrom a housing shaft wall 125. Reference number 126 represents the locking pin slide wall while reference number 127 represents the attachment legs for the male member. As shown in FIG. 8, a locking pin receiving portion 107 is provided.

Figure 9:
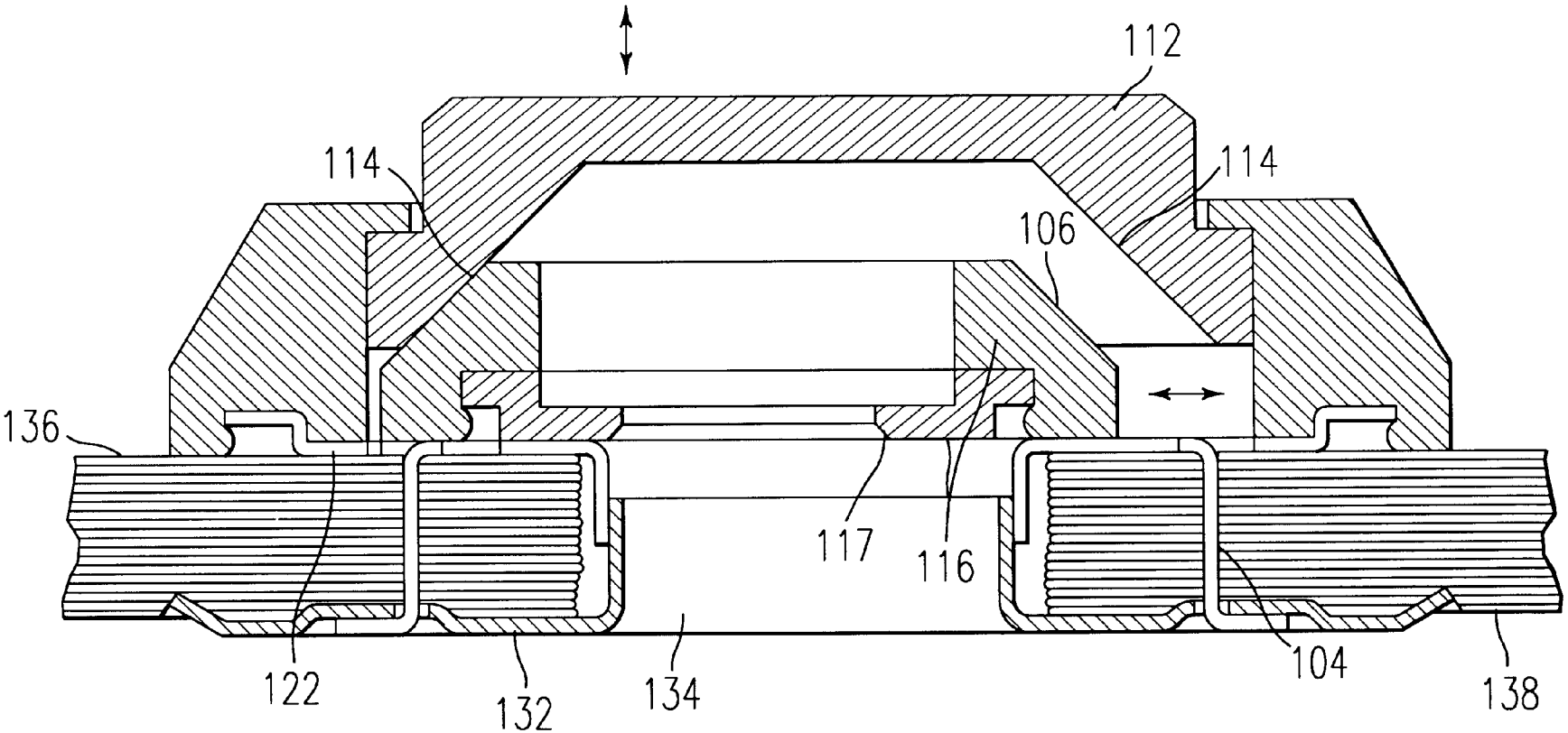
FIG. 9 shows details of the female member of the third embodiment.
Figure 11:
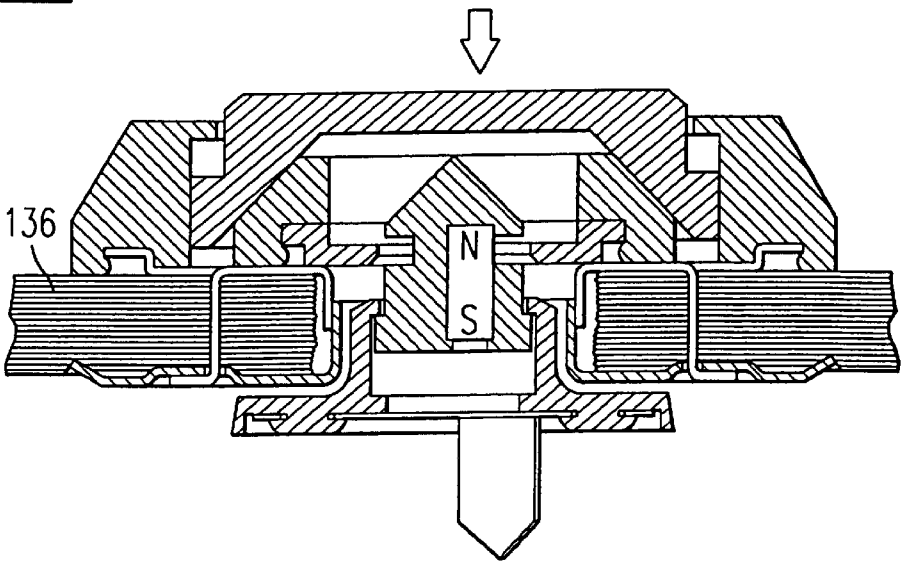
FIG. 11 shows the interrelationship of the male and female members in an unlocked position.
Figure 10:
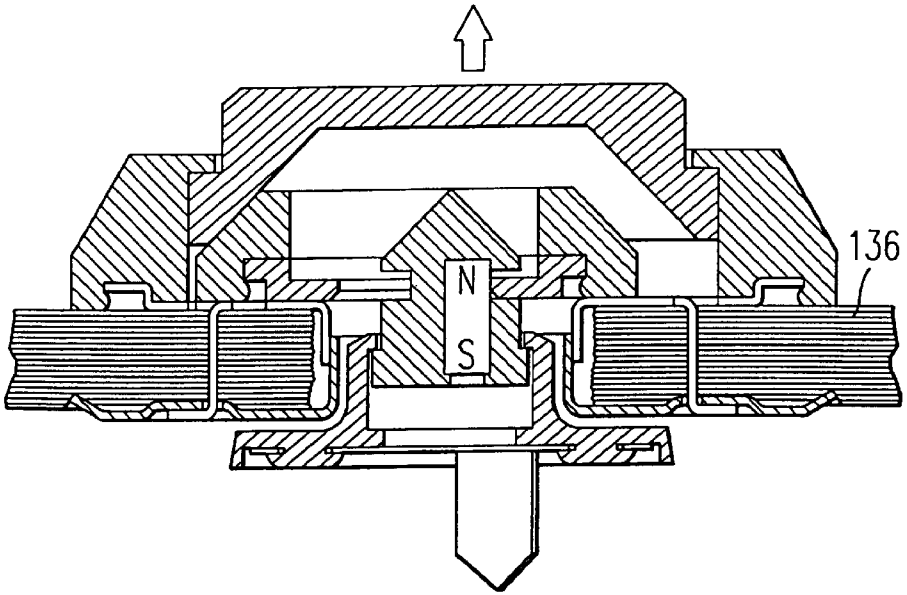
FIG. 10 shows the interrelationship of the male and female members in a locked position.
Figure 12:
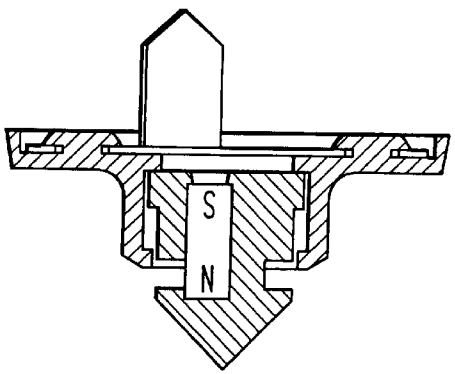
FIG. 12 shows the male member when retracted in the housing thereof.

FIG. 9 serves to illustrate the female assembly of the third embodiment and includes a housing 104, a lock ring 116 having a lock ring lip 117. Release button 112 includes a cam surface 114. Also illustrated is a receiving hole 134 for receiving the male member and a first attachment plate 132. Reference number 122 indicates a second attachment plate while number 136 indicates the leather to which the female part is secured. Reference number 127 indicates attachment prongs. As can thus be appreciated, upon downward movement of the release button 112, cam surface 114 engages cam surface 106 of the locking ring and forces the same to move in a direction toward the housing 104 so as to thus become centered beneath the release button 112. As illustrated in FIGS. 10 and 11, the male member is thus shifted for the locked position shown in FIG. 10 to the unlocked position shown in FIG. 11 due to movement of the lock ring 116 from a locked position in proximity with the magnet 130 to an unlocked position spaced from the magnet. FIG. 12 also illustrates the manner in which the male member can be retracted into a lowermost position within the housing shaft wall 125. It can thus be appreciated, when the male part is inserted into the female member, the locking pin 123 is drawn into the hole formed in the center of the lock ring 116. Locking ring lip 117 is pulled into the recess 107 at this time. Upon downward depression of release button 112, the locking ring 117 is shifted to the right as shown in FIG. 11 so as to no longer engage with the male member and become spaced from the magnet. Thus, FIG. 11 serves to illustrate the unlocked position of the overall assembly due to downward displacement of the release button 112.

Figure 15:
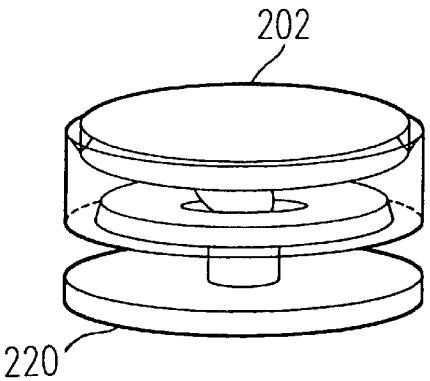
FIG. 15 is an exploded view of the third embodiment showing the locked or closed position.
Figure 14:
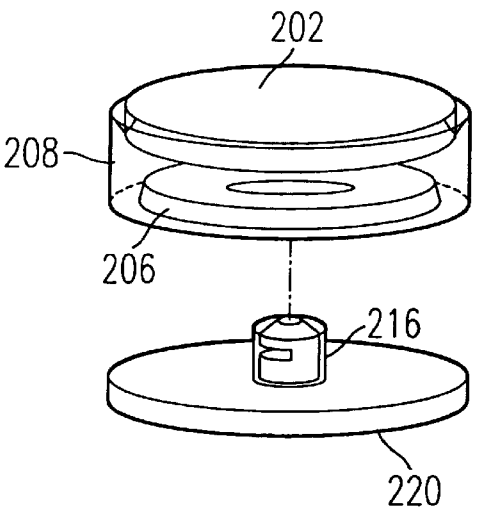
FIG. 14 is an exploded view of the fourth embodiment showing the unlocked or open position.
Figure 13:
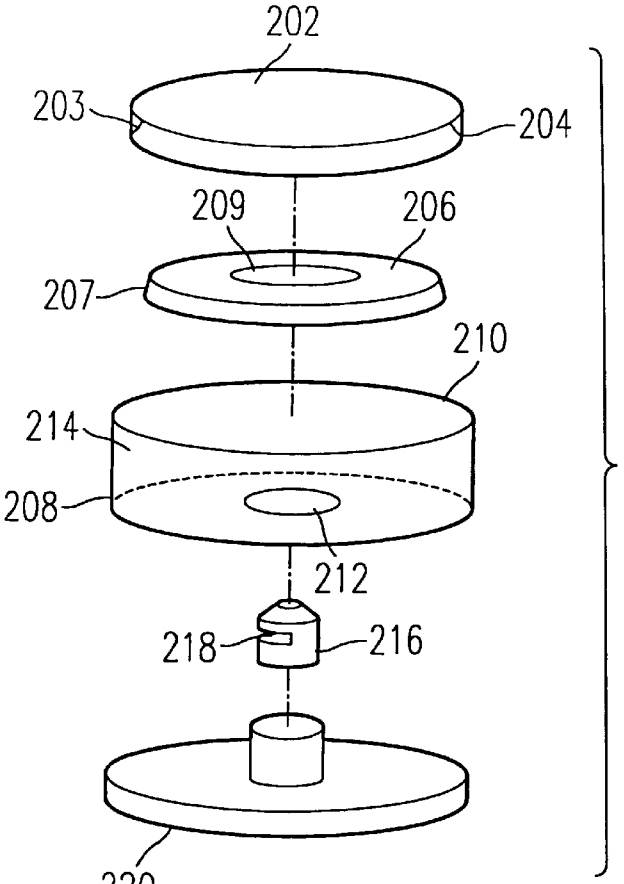
FIG. 13 is an exploded view of a fourth embodiment of the present invention.

As shown in the additional embodiment illustrated in FIGS. 13–15, showing exploded views thereof, the female assembly may comprises a three piece assembly which includes a top piece 202 having an inner cam surface 203 and a notch 204 formed thereon along the outer periphery of the top piece. A central member 206 having a central opening 209 is provided with it being noted that the central member may be a washer made of steel, iron or similar material with an outer cam surface 207 that is tapered. A cup 208 having an upper aperture 210 and a lower aperture 212 formed therein is also illustrated in FIG. 13. An inwardly extending notch 214 is formed on the inner surface of cup 208 and is engageable with the notch 204 located on the outer circumferential surface of top piece 202 to limit upward movement of the top piece 202 within cup 208 once the top piece has been snap fitted within the cup. Top piece 202 is upwardly biased by a spring (not shown) positioned between base 220 and the cup 208 and which also surrounds the outer edge of member 206 so as to upwardly bias top piece 202.

The male assembly includes a pin member 216 having a recess or notch 218 formed therein which is similar in nature to the male assembly 2 shown in FIG. 1 and which may have a base 220 and a magnet 216 positioned within the recess or notch 218 to which the metal washer is magnetically attracted and upwardly biased by an additional spring (not shown) if necessary. As would be understood by one of ordinary skill in the art, in the alternative, as in the first embodiment, the washer may instead be magnetic with the male assembly being provided with a steel or iron insert positioned within the recess or notch 218.

Due to locking engagement between the edge of central opening 209 of member 206 and the notch 218, the male assembly is normally in locking engagement with the female assembly. In an unlocking operation, it is noted that the spring upwardly biases the top piece 202 away from central member 206 but movement of top piece 202 in an upward direction is limited by engagement of notch 204 of the top piece 206 with notch 214 of the cup. By manually pushing the top piece 202 downwardly, the inner cam surface 203 engages an outermost portion of cam surface 207 so as to make slide member 206 slide towards center of cup 208 and become concentric therewith. Upon this action being accomplished, disengagement between notch 218 and an inner radial surface of central opening 209 of the slide member 206 occurs so as to thus unlock the female assembly from the male assembly in a manner similar to that described in the first embodiment. It is noted that the top piece 202 of the cup 208 and base member could, for example, be made of plastic or any other less costly material and need not be made of metal.

Figure 16:
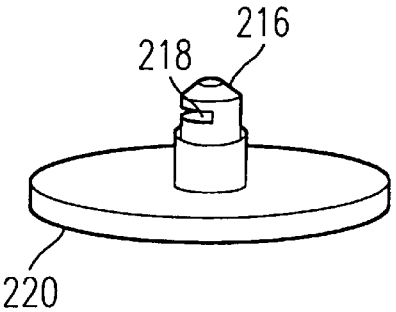
FIG. 16 illustrates the male member when assembled with the pin extended.

As can be appreciated from a review of FIGS. 13–16, each of FIGS. 13–15 show exploded views of the above-noted components whereas FIG. 16 shows the location of the pin member 216 when positioned within a cylindrical hollow portion of the base member and upwardly biased by a spring (not shown) located within such hollow portion. The pin can be moved downwardly to the position shown in FIG. 14 when the magnetic fastener is in an open position, as compared with the closed position illustrated in FIG. 15.

While the present invention has been disclosed with reference to the specific preferred embodiments and the particulars thereof, it is to be understood that obvious variations of the same would be understandable to one of ordinary skill in the art. These variations of the present invention are considered to be part of the disclosure set forth hereinabove.

What is claimed is:

1. A magnetic fastener including manually separable male and female assemblies, which comprises:

a female assembly including a movable lock member freely slidably positioned thereon and a lock release button movably mounted thereto; and a male assembly including a magnetic member, said male assembly being engageable with said lock release button;

said movable lock member having a cam positioned thereon and wherein at least a portion of said male assembly is positionable such that, in a locked position, said movable member is shiftable to a position in proximity with said ferromagnetic member and, upon engagement of said release button with said lock member, said lock member is shiftable to an unlocked position spaced from said magnetic member.

2. A magnetic fastener according to claim 1, wherein said lock release button and said lock member each have cam surfaces that are spaced apart in the unlocked position and are in contact with one another in said locked position.

3. A magnetic fastener according to claim 1, wherein said female member includes a housing within which said lock release button is movable.

4. A magnetic fastener according to claim 3, wherein said female assembly includes a first and second set ring which are used to limit movement of said lock release button and said lock member, respectively.

5. A magnetic fastener according to claim 1, wherein said female assembly includes a housing within which said lock member is movable.

6. A magnetic fastener according to claim 1, wherein said female assembly includes a first housing within which said lock release button is movable and a second housing within which said lock member is movable.

7. A magnetic fastener according to claim 1, wherein said female assembly includes a first and second set ring which are used to limit movement of said lock release button and said lock member, respectively.

8. A magnetic fastener according to claim 7, which comprises a washer positioned between said second set ring and said lock member and on which said lock member is slidable upon contact of said lock release button with said lock member.

9. A magnetic fastener according to claim 1, wherein said male member has a locking lip member for engaging a portion of said lock ring in the locked position.

10. A magnetic fastener as claimed in claim 1, wherein said male assembly comprises a housing and said magnetic member is moveable within said housing.

11. A magnetic fastener according to claim 10, wherein said male assembly includes a member which is moveable from a position extending outwardly from said housing to a position retracted within at least part of said housing.

12. A magnetic fastener as claimed in claim 10, wherein said locking ring is moveable from a locked position in proximity with said magnetic member to an unlocked position substantially spaced from said magnetic member.

13. A magnetic fastener as claimed in claim 10, wherein said locking ring is moveable from a locked position in proximity with said magnetic member to an unlocked position substantially spaced from said magnetic member.

14. A magnetic fastener as claimed in claim 13, wherein said female assembly comprises a housing and said magnetic member is moveable within said housing.

15. A magnetic member as claimed in claim 14, wherein said female assembly includes a member which is moveable from a position extending outward from said housing to a positioning retracted at least partially within said housing.

16. A magnetic fastener including manually separable male and female assemblies, which comprises:

a female assembly including a movable lock means freely slidably positioned thereon and lock release means movably mounted thereto; and a male assembly including a magnetic member, said male assembly being engageable with said lock release means;

said movable lock means having a cam positioned thereon wherein a portion of said male assembly is positionable such that, in a locked position, said movable lock means is shiftable to a position in proximity with said magnetic member and, upon engagement of said release button with said male assembly, said movable member is shiftable to an unlocked position spaced from said magnetic member.

17. A magnetic fastener as claimed in claim 16, wherein said lock release means and said lock means each have cam surfaces that are spaced apart in the locked position and are in contact with one another in said unlocked position.

18. A magnetic fastener according to claim 16, wherein said female assembly includes a housing within which said lock release means is movable.

19. A magnetic fastener according to claim 18, wherein said female assembly includes a first and second set means which are used to limit movement of said lock release means and said lock means, respectively.

20. A magnetic fastener according to claim 16, wherein said female assembly includes a housing within which said lock member is movable.

21. A magnetic fastener according to claim 16, wherein said female assembly includes a first housing within which said lock release means is movable and a second housing within which said lock means is movable.

22. A magnetic fastener according to claim 16, wherein said female assembly includes a first and second set means which are used to limit movement of said lock release means and said lock means, respectively.

23. A magnetic fastener according to claim 22, which comprises a washer positioned between said second set means and said lock means and on which said lock means is slidable upon contact of said lock release means with said lock means.

24. A magnetic fastener according to claim 16, wherein said male member has locking lip means for engaging a cam face portion of said lock means in the locking position.

25. A magnetic fastener as claimed in claim 16, wherein said male assembly comprises a housing and said magnetic member is moveable within said housing.

26. A magnetic fastener including manually separable male and female assemblies, which comprises:

a female assembly including a movable magnetic member slidably positioned thereon and a lock release button movably mounted thereto; and a male assembly including a lock member, said male assembly being engageable with said lock release button;

said movable magnetic member having a cam positioned thereon wherein at least a portion of said male assembly is positionable such that, in a locked position, said movable magnetic member is shiftable to a position in proximity with said lock member and, upon engagement of said release button with said magnetic member, said magnetic member is shiftable to an unlocked position spaced from said lock member.

27. A magnetic fastener according to claim 26, wherein said lock release button and said magnetic member each have cam surfaces that are spaced apart in the unlocked position and are in contact with one another in said locked position.

28. The method according to claim 27, wherein said female assembly includes a housing and which comprises:

positioning said lock release button in said housing so as to be movable towards and away from said locking member; and positioning said lock member in said housing so as to have a portion thereof movable towards and away from said magnetic member in the locked and unlocked position of the fastener, respectively.

29. A magnetic fastener according to claim 26, wherein said female member includes a housing within which said lock release button is movable.

30. A magnetic fastener according to claim 29, wherein said female assembly includes a first and second set ring which are used to limit movement of said lock release button and said magnetic member, respectively.

31. A magnetic fastener according to claim 26, wherein said female assembly includes a housing within which said magnetic member is movable.

32. A magnetic fastener according to claim 26, wherein said female assembly includes a first housing within which said lock release button is movable and a second housing within which said magnetic member is movable.

33. A magnetic fastener according to claim 26, wherein said female assembly includes a first and second set ring which are used to limit movement of said lock release button and said magnetic member, respectively.

34. A magnetic fastener according to claim 33, which comprises a washer positioned between said second set ring and said lock member and on which said magnetic member is slidable upon contact of said lock release button with said magnetic member.

35. A magnetic member as claimed in claim 34, wherein said male assembly includes a member which is moveable from a position extending outward from said housing to a position retracted at least partially within said housing.

36. A magnetic fastener according to claim 36, wherein said male member has a locking lip member for engaging a portion of said magnetic member in the locked position.

37. The method as claimed in claim 26, which comprises forming each of said lock release button and said lock member so as to have a cam face and contacting said cam face of said lock release button and said lock member in the unlocked position of the fastener.

38. A magnetic fastener as claimed in claim 26, wherein said female assembly comprises a housing and said magnetic member is moveable within said housing.

39. A magnetic fastener according to claim 38, wherein said female assembly includes a member which is moveable from a position extending outwardly from said housing to a position retracted within at least part of said housing.

40. A magnetic fastener as claimed in claim 38, wherein said magnetic member is moveable from a locked position in proximity with said lock member to an unlocked position substantially spaced from said lock member.

41. A magnetic fastener as claimed in claim 38, wherein said locking ring is moveable from a locked position in proximity with said magnetic member to an unlocked position substantially spaced from said magnetic member.

42. A magnetic fastener including manually separable male and female assemblies, which comprises:

a female assembly including a movable magnetic means slidably positioned thereon and lock release means movably mounted thereto; and a male assembly including a lock member, said male assembly being engageable with said lock release means;

said movable magnetic means having a cam positioned thereon and wherein a portion of said male assembly is positionable such that, in a locked position, said magnetic member is shiftable to a position in proximity with said lock member and, upon engagement of said release button with said male assembly, said magnetic member is shiftable to an unlocked position spaced from said lock member.

43. A magnetic fastener as claimed in claim 42, wherein said lock release means and said magnetic means each have cam surfaces that are spaced apart in the locked position and are in contact with one another in said locked position.

44. A magnetic fastener according to claim 42, wherein said female assembly includes a housing within which said lock release means is movable.

45. A magnetic fastener according to claim 44, wherein said female assembly includes a first and second set means which are used to limit movement of said lock release means and said magnetic means, respectively.

46. A magnetic fastener according to claim 42, wherein said female assembly includes a housing within which said magnetic means is movable.

47. A magnetic fastener according to claim 42, wherein said female assembly includes a first housing within which said lock release means is movable and a second housing within which said magnetic means is movable.

48. A magnetic fastener according to claim 42, wherein said female assembly includes a first and second set means which are used to limit movement of said lock release means and said magnetic means, respectively.

49. A magnetic fastener according to claim 48, which comprises a washer positioned between said second set means and said lock means and on which said magnetic means is slidable upon contact of said lock release means with said lock means.

50. A magnetic fastener according to claim 42, wherein said male member has locking lip means for engaging a cam face portion of said magnetic means in the locking position.

51. A method of fastening a fastener having a female assembly including a lock member, a lock release button and a male assembly having a magnetic member, which comprises:

positioning said lock member in said female assembly so as to be freely slidable therein;

positioning said lock release button in said female assembly so as to be spaced from said lock member in a locked position of said fastener and to be in contact with said lock member in an unlocked position of said fastener; and engaging said lock release button assembly with said lock member so as to slide said lock member from a position in proximity with said magnetic member in the locked position of the fastener and to be spaced from said magnetic member in the unlocked position of said fastener.

52. A fastener made by the process claimed in claim 51.

53. A method as claimed in claim 51, wherein said male assembly includes a housing and which comprises moving a portion of said male assembly within said housing.

54. A method as claimed in claim 53, which comprises moving said member of said male assembly at least partially inwardly into said housing during moving of said member of said male assembly.

55. A method as claimed in claim 53, which comprises moving said locked member from a locked position in proximity with said magnetic member to an unlocked position spaced from said magnetic member.

56. A method of fastening a fastener having a male assembly including a lock member, a lock release button and a female assembly having a magnetic member, which comprises:

positioning said lock member in said female assembly so as to be freely slidable therein;

positioning said lock release button in said female assembly so as to be spaced from said lock member in a locked position of said fastener and to be in contact with said lock member in an unlocked position of said fastener; and engaging said lock release button with said magnetic member so as to slide said magnetic member from a position in proximity with said lock member in the locked position of the fastener and to be spaced from said lock member in the unlocked position of said fastener.

57. The method as claimed in claim 56, which comprises forming each of said lock release button and said magnetic member so as to have a cam face and contacting said cam face of said lock release button and said magnetic member in the unlocked position of the fastener.

58. The method according to claim 57, wherein said female assembly includes a housing and which comprises:

positioning said lock release button in said housing so as to be movable towards and away from said magnetic member; and positioning said magnetic member in said housing so as to have a portion thereof movable towards and away from said lock member in the locked and unlocked position of the fastener, respectively.

59. A fastener made by the process claimed in claim 56.

60. A method as claimed in claim 56, wherein said male assembly includes a housing and which comprises moving a portion of said male assembly within said housing.

61. A method as claimed in claim 60, which comprises moving said member of said male assembly at least partially inwardly into said housing during moving of said member of said male assembly.

62. A method as claimed in claim 60, which comprises moving said locked member from a locked position in proximity with said magnetic member to an unlocked position spaced from said magnetic member.

* * * * *